United States Patent [19]

Steele et al.

[11] Patent Number: 4,745,637

[45] Date of Patent: May 24, 1988

[54] HEAD PROTECTOR

[76] Inventors: Richard J. Steele; Maribel Steele, both of 2202 Harwell, Houston, Tex. 77023

[21] Appl. No.: 29,052

[22] Filed: Mar. 23, 1987

[51] Int. Cl.[4] ..... A42B 3/02

[52] U.S. Cl. ..... 2/411; 2/413; 2/421

[58] Field of Search ..... 2/411, 410, 425, 412, 2/413, 414, 421

[56] References Cited

U.S. PATENT DOCUMENTS

| | | | |
|---|---|---|---|
| 882,686 | 3/1908 | Ireland et al. | 2/413 |
| 2,814,043 | 11/1957 | Alesi | 2/421 |
| 3,555,561 | 1/1971 | Neis | 2/411 |
| 3,994,020 | 11/1976 | Villari | 2/413 |
| 4,343,047 | 8/1982 | Lazowski et al. | 2/411 |
| 4,613,993 | 9/1986 | Steele et al. | 2/411 |

*Primary Examiner*—Louis K. Rimrodt
*Assistant Examiner*—Judith L. Olds
*Attorney, Agent, or Firm*—James A. Bargfrede

[57] ABSTRACT

In a head protector for children and invalids, a series of concentric rings of tubular fabric packed with yieldable material and a top member of yieldable material, and straps binding said rings and top together, a ring of spaced cushions, or pillows, between the lowermost ring and the adjacent ring, and means for positioning said protector on a user's head and maintaining same against rearward movement.

2 Claims, 1 Drawing Sheet

HEAD PROTECTOR

BACKGROUND OF THE INVENTION

Many head protecting devices are on the market, such as helmets for sports, motorcycling and the like, none of which are designed to protect small children from head injuries due to falls, and bumps, against furniture and the like, or for children with head injuries in need of protection. This application is an improvement of the device disclosed in applicant's application for patent filed Dec. 27, 1984, Ser. No. 686,913, which has matured into U.S. Pat. No. 4,613,993.

BRIEF SUMMARY OF THE INVENTION

A head protector having a series of concentric rings filled with a yieldable packing material and a top cushion of reduced diameter and providing a series of yeldable cushions between the lowermost ring and the adjacent ring, preferably in the form of pillows, spaced uniformly apart circumferentially, and binding means holding the rings in position and a back strap maintaining the protector against forward movement on the head of the user, as well as a forward strap to maintain the protector against rearward movement.

DESCRIPTION OF THE PREFERRED EMBODIMENT

Figure 1:
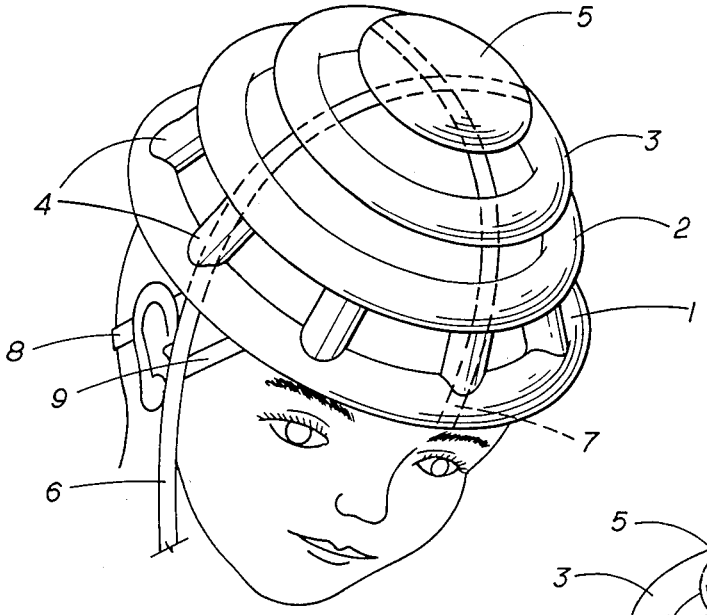
FIG. 1 is a front perspective view, showing the protector on the head of a user.
Figure 2:
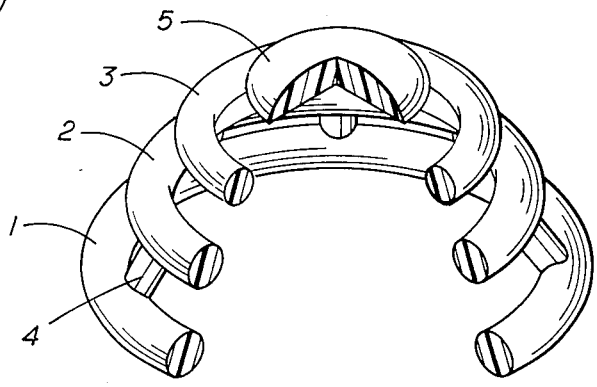
FIG. 2 is a front elevational view of the rings and top, with a portion of the protector cut away showing cross sectional view of the rings, cusions and top.
Figure 3:
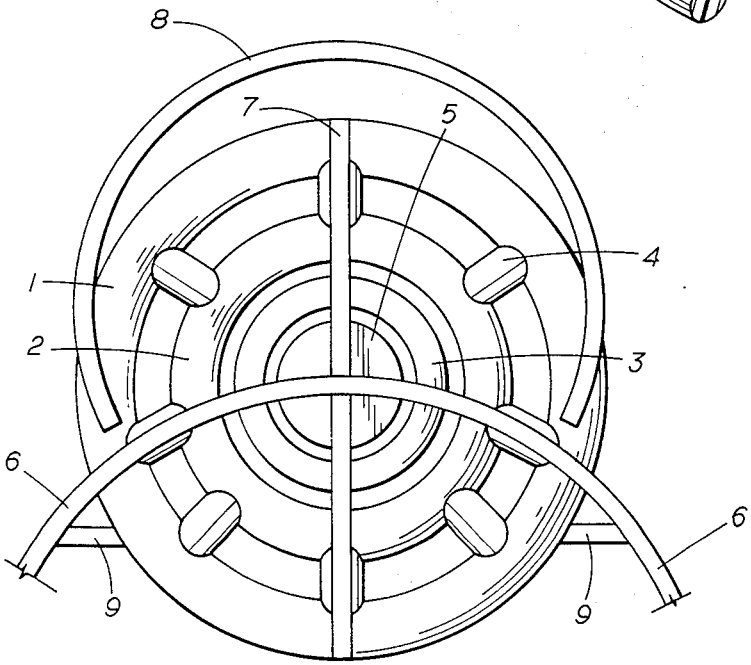
FIG. 3 is bottom view, showing the inside surface of the protector.

In the drawings, the numeral 1 designates the lower tubular ring, being preferably formed of an annular washable fabric casing, packed with a suitable yieldable packing material such as polyester packing. An example of this packing now on the market is Poly-fil, a product of Fairfield Processing Corporation. The middle ring 2 and top ring 3 are similarly formed, but of less circumerential diameter to fit the head of a user. Cushions, or pillows, formed of rectangular casings 4, which are mounted between the rings 1, 2 and are spaced apart, forming a ring of of yieldable blocks, and an annular pillow 5, forms the top member, or cap, which covers the crown of the user's head. The pillows 4 present a ring of cushioning material to receive and cusion blows from the side of the user.

Mounted on the inside of the protector are the tie members 6, which extend outwardly from the ring 1 and form the means of securing the protector on the head of the user. Said straps also form reinforcing means of fabric 6 which bind the rings together and the rear strap 8 is secured to the ring 1 and extends outwardly to secure the rings in position and prevent their shifting forwardly, and the front straps 9, 9, secured to the ring 1 and to the strap 6, prevent rearward shifting of the rings while on the head of the user.

In use, the lower ring forms the bottom of the protector and the straps, or ribbons, 6, are tied under the chin of the user, securing the protector in position. The top member 5 protects the very vunerable top of the head of the user, and the pillows 4 prevent damage from lateral collision with furniture, or protruding parts of furniture, and the like, particularly in the use of the device by young children, such as infants learning to walk, or persons with head injuries or invalids with little control of their head movement.

What we claim is:

1. A head protector including in combination a plurality of concentric rings including an upper ring, a lower ring, and an intermediate ring between said upper ring and said lower ring, said rings being formed of tubular casing packed with yieldable material, a top member positioned above said upper ring, a plurality of fabric straps connected to said top member and to said plurality of concentric rings, and a plurality of cushion members connected between said lower ring and said intermediate ring.

2. A head protector defined by claim 1 wherein one of said fabric straps is secured at each of its ends to said lower ring and extending outwardly to form a back strap anchoring said protector against forward movement and a plurality of front bands each anchored at one end to one of said fabric straps and at the other end to said lower ring.

* * * * *